US009730469B2

(12) United States Patent
Lisan et al.

(10) Patent No.: US 9,730,469 B2
(45) Date of Patent: Aug. 15, 2017

(54) TOBACCO SMOKE FILTER

(71) Applicant: ESSENTRA FILTER PRODUCTS DEVELOPMENT CO. PTE. LTD

(72) Inventors: Ahmad Fashihul Lisan, Sidoarjo (ID); Sudirman Widiarto, Sidoarjo (ID)

(73) Assignee: ESSENTRA FILTER PRODUCTS DEVELOPMENT CO. PTE. LTD., Singapore (SG)

( * ) Notice: Subject to any disclaimer, the term of this patent is extended or adjusted under 35 U.S.C. 154(b) by 81 days.

(21) Appl. No.: 14/377,283

(22) PCT Filed: Feb. 7, 2013

(86) PCT No.: PCT/EP2013/052385

§ 371 (c)(1),
(2) Date: Aug. 7, 2014

(87) PCT Pub. No.: WO2013/117620

PCT Pub. Date: Aug. 15, 2013

(65) Prior Publication Data

US 2015/0040931 A1 Feb. 12, 2015

(30) Foreign Application Priority Data

Feb. 8, 2012 (GB) ..... 1202220.8

(51) Int. Cl.
*A24D 3/02* (2006.01)
*A24D 3/04* (2006.01)
*A24D 3/10* (2006.01)

(52) U.S. Cl.
CPC ..... *A24D 3/0237* (2013.01); *A24D 3/0204* (2013.01); *A24D 3/0212* (2013.01); *A24D 3/0229* (2013.01); *A24D 3/04* (2013.01); *A24D 3/10* (2013.01)

(Continued)

(58) Field of Classification Search
USPC ..... 131/280, 331, 332, 341, 342, 344, 345; 493/39–50
See application file for complete search history.

(56) References Cited

U.S. PATENT DOCUMENTS 4,228,246 A 10/1980 Taub et al.
4,281,671 A 8/1981 Bynre et al.
(Continued)

FOREIGN PATENT DOCUMENTS

WO WO 03/082558 A1 10/2003
WO WO 2010/108739 A1 9/2010
(Continued)

OTHER PUBLICATIONS

Definition of filamentary, Wictionary, [online], No Date, retrieved fron the Internet, [retrieved Feb. 13, 2016],URL:http://www.yourdictionary.com/filamentary.*
(Continued)

*Primary Examiner* — Dennis Cordray
(74) *Attorney, Agent, or Firm* — Flynn, Thiel, Boutell & Tanis, P.C.

(57) ABSTRACT

The invention provides a method of producing a tobacco smoke filter or filter element comprising: • heat treating a continuously advancing longitudinally extending strand of material; • cooling the heat treated continuously advancing strand; and • forming a longitudinally extending outer layer of tobacco smoke filtering material around the continuously advancing strand, to form a continuously advancing rod comprising a longitudinally extending strand (1*a*) of material and a longitudinally extending outer layer (2*a*) of tobacco smoke filtering material engaged around the longitudinally extending strand (1*a*). An apparatus for carrying out the method, and products of the method, are also provided.

15 Claims, 2 Drawing Sheets

(56) References Cited

U.S. PATENT DOCUMENTS

Figure 1:
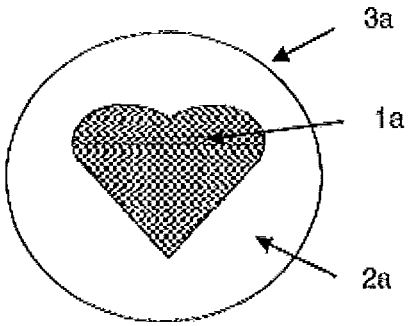

| | | | | |
|---|---|---|---|---|
| 4,291,711 | A | 9/1981 | Berger | |
| 2010/0294288 | A1* | 11/2010 | Sampson | A24D 3/0212 131/274 |
| 2012/0291792 | A1* | 11/2012 | Treadaway | A24D 3/048 131/276 |

FOREIGN PATENT DOCUMENTS

| | | | |
|---|---|---|---|
| WO | WO 2011/058319 | A1 * | 5/2011 |
| WO | WO 2011/148130 | A1 | 12/2011 |

OTHER PUBLICATIONS

"NaturacellTM Molding Conditions", Rotuba, [online], No Date, retrieved fron the Internet, [retrieved Feb. 13, 2016], <URL: http://www.rotuba.com/wp-content/uploads/2014/05/ NaturacellT_Cellulose_Acetate_Molding_Conditions_10-08.pdf>.*

Definition of Pigment , Merriam-Webster, [online], No Date, retrieved fron the Internet, [retrieved Feb. 16, 2016], <URL: http://www.merriam-webster.com/dictionary/pigmen>.*

Definition of "strand", Your Dictionary, 2010-2016, [online], retrieved from the Internet, [retrieved Jun. 16, 2016], <URL: http://www.yourdictionary.com/strand>.*

Form PCT/ISA/210 issued in PCT/EP2013/052385 dated May 14, 2013 (5 pages).

Form PCT/ISA/220 issued in PCT/EP2013/052385 dated May 14, 2013 (1 page).

Form PCT/ISA/237 issued in PCT/EP2013/052385 dated May 14, 2013 (5 pages).

* cited by examiner

TOBACCO SMOKE FILTER

This invention relates to production of tobacco smoke filters and filter elements, for example "strand" filters and filter elements which have an inner strand or core of circular or non-circular cross section, an outer layer of air-permeable (tobacco smoke filtering) material encasing (engaged around) the strand and, optionally, an outer wrapper engaged around the outer layer.

'Flavour Thread' cigarette filters are well known in the prior art. Such filters incorporate a thread or tape element, typically longitudinally aligned therein, the element carrying a smoke modifying agent such as a flavourant. These were originally proposed in U.S. Pat. No. 4,281,671, in which a narrow cotton sewing thread was the preferred element.

Concentric core cigarette filters, which comprise an inner cylindrical core of one filtering material surrounded by outer layer (annulus or annular layer) of another filtering material are also known. These are also known as Co-axial core filters (CCF). The use of two such different filtering materials for the core and outer annular layer can give rise to an unsightly end appearance in the final filter cigarette and it is thus conventional for the concentric core filter to be employed in a dual or other multiple component filter, in addition to a plain buccal end plug of acceptable uniform end appearance. The unsightly appearance may be reduced or eliminated by ensuring that the inner core is located centrally (within the outer layer). The present applicants have also developed "concentric" core filters in which the inner core has a defined, non-circular, cross section (for example a star shaped cross section or heart shaped cross section). This provides a distinctive and more attractive end appearance to the filter and eliminates the usual need for a concentric core filter to be combined with a plain buccal end plug, thereby reducing the cost and number of steps of the overall filter manufacturing operation.

The present applicant has now developed a strand filter or filter element which includes a rod of tobacco smoke filtering material engaged around a "strand" (or more than one strand) which comprises a continuous, generally extruded, element which extends longitudinally through the rod. In contrast to CCF (where both core and annulus are generally filtering materials), the strand does not require filtering capabilities and may well be almost entirely impervious to smoke flow; this is because the strand filter is a visual product designed to provide a distinctive (and more attractive) end appearance to a product filter cigarette, which may be advantageous for anti-counterfeiting purposes. The strand (or each strand, if more than one strand is present) generally comprises a single (extruded) filamentary element, which is preformed—e.g. through extrusion of plasticized cellulose acetate (CA) or other polymer. The strand may provide a visual cue because it can be formed in wider diameters than a simple thread or tape, and may be formed in a variety of cross sections. The strand may also act as a medium for holding flavours in flavour filters (see below). To provide advantageous end appearance, it is necessary that the strand is located accurately in the outer layer of tobacco smoke filtering material: for example, if the filter or filter element includes a single strand it is necessary or desirable that the strand is located substantially centrally (within the outer layer); if the filter or filter element includes two or more strands it is necessary that the strands are located accurately in relation to each other and within the outer layer As set out above, the strand is generally pre-formed, for example by the extrusion of plasticised cellulose acetate material. After forming, the strand is generally wound (e.g. onto a reel or bobbin), for ease of transport and storage prior to manufacture into the product strand filter rod. In order to provide a distinctive and more attractive end appearance to the filter, the strand (e.g. having a circular or, more preferably, a defined, non-circular, cross section) will generally have a relatively broad cross section compared to a thread or tape used in a flavour thread type filter, for example a cross section of 1.4 mm or 2.5 mm at its broadest point (or a diameter of 1.4 mm or 2.5 mm in the case of a circular cross section) for a cigarette filter, or even a cross section of up to 10 mm for use in/with a cigar. The applicants have found that strands having these relatively broad cross sections (diameters), especially those of non-circular cross section, are prone to a bowing or bending effect after unwinding, which may result in an unacceptable (reject) final product filter (rod) with an out of position strand. There is therefore a need to provide effective location of the strand or strands in the final product rod (i.e. effective positioning).

According to the present invention in a first aspect there is provided a method of producing a tobacco smoke filter or filter element comprising:

heat treating (e.g. to a temperature of 40° to 130° C., preferably to a temperature of 100° to 120° C.) a continuously advancing longitudinally extending strand (e.g. inner core) of material (e.g. a strand having a circular or non-circular cross section);

cooling the heat treated continuously advancing (longitudinally extending) strand (e.g. to ambient temperature, e.g. to a temperature of 10° to 30° C., preferably to a temperature of 15° to 20° C.); and forming a longitudinally extending outer layer (e.g. a substantially annular outer layer) of tobacco smoke filtering material around the continuously advancing (longitudinally extending) strand, to form a continuously advancing rod comprising a longitudinally extending strand (e.g. inner core) of material (e.g. having a circular or non-circular cross section) and a longitudinally extending outer layer (e.g. a substantially annular outer layer) of tobacco smoke filtering material engaged (e.g. wrapped) around the longitudinally extending strand.

It will be appreciated that the method may be used to produce filters or filter elements which include more than one strand. Thus, the invention may provide a method of producing a tobacco smoke filter or filter element comprising:

heat treating (e.g. to a temperature of 40° to 130° C., preferably to a temperature of 100° to 120° C.) two or more continuously advancing longitudinally extending strands (e.g. inner cores) of material;

cooling the heat treated continuously advancing (longitudinally extending) strands (e.g. to ambient temperature, e.g. to a temperature of 10° to 30° C., preferably to a temperature of 15° to 20° C.); and forming a longitudinally extending outer layer (e.g. a substantially annular outer layer) of tobacco smoke filtering material around the continuously advancing (longitudinally extending) strands, to form a continuously advancing rod comprising longitudinally extending strands (e.g. inner cores) of material and a longitudinally extending outer layer (e.g. a substantially annular outer layer) of tobacco smoke filtering material engaged (e.g. wrapped) around the longitudinally extending strands.

The (or each) continuously advancing longitudinally extending strand may be a preformed strand. Herein, the term "preformed" means that the strand is formed at least 10 seconds (e.g. at least 15 minutes, e.g. at least 10 seconds to 30 days or longer) before the longitudinally extending outer layer of tobacco smoke filtering material is formed around the continuously advancing (longitudinally extending) strand.

Preferably the (or each) continuously advancing longitudinally extending strand does not comprise a tobacco smoke filtering material. The strand may be impermeble or substantially impermeable to air and/or (tobacco) smoke.

The (or each) continuously advancing longitudinally extending strand may be a single (e.g. uncrimped) filamentary element.

As set out above, the present applicants have developed a filter or filter element which includes a layer of tobacco smoke filtering material engaged around a strand (or more than one strand). The or each strand may comprise a continuous element which extends longitudinally through the filter or filter element. The strand is generally a single filamentary element. Preferably the strand does not comprise a tobacco smoke filtering material. In other words, it is preferable that the strand is not capable of filtering tobacco smoke. The strand may be, for example, a single (e.g. uncrimped) filamentary element (e.g. formed of extruded plasticised cellulose acetate or other polymer). The strand is generally preformed. In other words, the strand is generally formed by a different process to that in which the longitudinally extending outer layer of tobacco smoke filtering material is formed around the continuously advancing strand, and hence is formed at least 10 seconds (e.g. at least 15 minutes, e.g. at least 10 seconds to 30 days, or even longer) before the longitudinally extending outer layer of tobacco smoke filtering material is formed around the continuously advancing strand. This is in direct contrast to CCF wherein the longitudinally extending core comprises a tobacco smoke filtering material (e.g. comprising a multitude of smaller, crimped, filaments, rather than a single filamentary strand of non-smoke filtering material), and is formed as part of the process of manufacture of the CCF as, or immediately before, the outer layer (annulus or annular layer) of filtering material is formed around the core.

Preferably, the (or each) continuously advancing longitudinally extending strand has a non-circular cross section.

Preferably the (or each) continuously advancing (longitudinally extending) strand (e.g. inner core) of material comprises an extruded material (an extruded element). Preferably the (or each) continuously advancing (longitudinally extending) strand (e.g. inner core) of material comprises a thermoplastic polymer or thermoplastic elastomer, for example an extruded thermoplastic polymer. The thermoplastic polymer may be, for example, cellulose acetate, polyethylene, polypropylene, polylactic acid, polyester or mixture thereof. Preferably, the (or each) strand comprises cellulose acetate. Methods of preparing extrusion grade cellulose acetate powder are known (e.g. see U.S. Pat. No. 4,228,246). Extrusion-grade cellulose ester pellets are commercially available from Rotuba Extruders of Linden, N.J. under the trade mark "Naturacell". The extrusion-grade cellulose ester pellets are converted into an extruded element for use according to the invention. The (or each) strand may further comprise a plasticiser (e.g. triacetin). The amount of plasticiser in the strand may be from 7 to 42% by weight of the strand, for example from 15.1 to 35% by weight of the strand. Preferably the (or each, or a) longitudinally advancing strand is preformed, for example by extrusion, for example by extrusion of plasticised CA or other polymer. The (or each) strand may be a tobacco smoke filtering material (e.g. (filamentary) cellulose acetate tow) but this is not preferred.

The heat treating (e.g. to a temperature of 40° to 130° C., preferably to a temperature of 100° to 120° C.) may be by the application of steam to the continuously advancing longitudinally extending strand.

It will appreciated that the cooling may be by actively cooling the longitudinally extending strand (e.g. by application of cool air to the strand etc.) or by allowing it to cool to the appropriate temperature.

The (or each) continuously advancing (longitudinally extending) strand of material is preferably under tension (e.g. straightened under tension) during the heat treatment (and optionally during the cooling step). The tension may be applied, for example, by (the action of) advancing (e.g. pulling) the strand (e.g. from the location, such as a reel or bobbin on which it is stored). The tension preferably straightens the strand (i.e. holds the strand straight) during the heat treatment (and optionally during the cooling step).

The applicants have found that pre-processing the (or each) strand by heating it and cooling it (allowing it to cool), preferably under tension, prior to forming the outer layer greatly reduces or eliminates the bowing or bending effect.

The (or each) strand (e.g. strand of circular or non-circular cross section) may have a cross section of 0.7 mm to 10 mm, preferably from 0.7 mm to 2.6 mm (for example 0.7 to 0.9 mm or 1.2 mm to 2.6 mm, for example 0.8 mm, 1.4 mm or 2.5 mm) at its broadest point. Thus, a strand of circular cross section may have a cross section of diameter 0.7 mm to 10 mm, preferably from 0.7 mm to 2.6 mm (for example 0.7 to 0.9 mm or 1.2 mm to 2.6 mm, for example 0.8 mm, 1.4 mm or 2.5 mm). It will be appreciated that the number of strands that can be included is related to the diameter of the strands in comparison to that of the filter. For example, in a 24.5 mm circumference filter it is possible to include two strands of 0.8 or 1.4 mm diameter by the process of the invention, but only one 2.5 mm diameter strand.

The (or each) strand (e.g. strand of non-circular cross section) is preferably advanced longitudinally (e.g. passes, is fed) through a positioning apparatus (e.g. immediately) prior to formation of the longitudinally extending outer layer around the strand. The positioning apparatus guides the (or each) advancing strand in a direction which is substantially the same as the direction in which the (or each) strand advances after formation of the longitudinally extending outer layer around the strand. The positioning apparatus may also guide the (or each) advancing strand in a direction which is substantially the same as the direction in which the strand advances before travelling through the positioning apparatus [so the (or each) strand advances in substantially the same direction from the heating/cooling, through the positioning apparatus, until formation of the longitudinally extending outer layer around the strand(s)]. The positioning apparatus may include a delivery channel through which the (or a, or each) strand advances to the gathering device. The positioning apparatus may include a single delivery channel through which the strand or strands advance to the gathering device, or may include a delivery channel for each strand. The delivery channel may be, for example, a hollow tube (e.g of internal diameter from 0.5 to 11 mm, preferably internal diameter from 0.5 to 2.7 mm, for example 0.7 to 2.6 mm, for example 1.2 to 2.5 mm) which is oriented in substantially the same as the direction in which the strand advances after formation of the longitudinally extending outer layer around the strand. The positioning apparatus guides the (or each) advancing strand into the correct position so the longitudinally extending outer layer is formed around the strand or strands with the strand located accurately within the outer layer.

The method may provide filters and filter elements having distinctive and attractive end appearance because of their (e.g. shaped) accurately located strand. The distinctive end appearance with a centrally located strand (or an accurately positioned pattern of strands) provided to the finished filter cigarette may be advantageous for anti-counterfeiting purposes.

Preferably the longitudinally extending outer layer of tobacco smoke filtering material is engaged around (e.g. surrounds) the (or each) longitudinally extending strand (inner core) such that the outer face of the (or each) strand (inner core) is enclosed by the longitudinally extending outer layer of tobacco smoke filtering material.

The product filter or filter element is generally circular or oval in cross section. The (or each) longitudinally extending strand (inner core) may be of circular or oval cross section, or of star shaped, trilobal, pentagonal, cog-shaped, heart-shaped or logo shaped cross section, or other non-circular cross section. Preferably, the (or each) longitudinally extending strand (inner core) does not have a helical cross section.

The longitudinally extending outer layer comprises a tobacco smoke filtering material. Preferably, the filtering material of the outer layer (surrounding substantially annular body) is a (e.g. gathered and bonded) cellulose acetate tow, optionally including a plasticiser (e.g. glyceryl triacetate). Other fibrous or filamentary material may also be employed in either the outer layer. The outer layer preferably adheres to the strand material to resist separation.

The (or each) strand (inner core) and/or outer layer may include a pigment. The (or each) strand (inner core) is preferably of a contrasting colour to the outer layer. Preferably, the (or each) strand (inner core) will (include pigment and) be of a different colour to the outer layer to accentuate the end appearance of the filter. For example, the strand (inner core) may be red, blue, green or black in colour and the outer layer may be white. If more than one strand is present they may be of contrasting colours, or the same colour.

The (or each) strand may further comprise a smoke modifying agent (e.g. flavourant such as menthol etc.). However, the strand(s) generally comprises a relatively non-porous material and its flavour-bearing capacity may therefore be low. Thus, other known methods for applying flavours to the filter may be used alternatively or additionally to applying flavour to the strand (e.g. direct injection of liquid flavours or molten menthol into the condensing tow stream).

Preferably the filtering material which forms the outer layer is a cellulose acetate tow, optionally including a plasticiser (e.g. glyceryl triacetate). The method may include a further step of heat treating the advancing outer layer of tobacco smoke filtering material as and/or or shortly after it is formed (e.g. condensed) around the (or each) continuously advancing longitudinally extending (inner) strand, optionally with a subsequent cooling step. The heat treatment (and optional cooling) may activate the plasticiser (if present) to form the filtering material into a coherent, bonded, smoke-permeable structure around the strand (e.g. if no wrapper is present).

The method may further comprise a step of applying a wrapper around the continuously advancing rod. A product filter or filter element according to any aspect of the invention is preferably wrapped in an outer plug wrap. This plug wrap may be porous or non-porous.

The method may further comprise a step of cutting the continuously advancing rod into single or multiple length filters or filter elements. The product filters or elements according to the invention are preferably formed in a continuous length and then cut into finite lengths. These may be a multiple (e.g. quadruple or sextuple) of the length of the eventual filter tips. The product filter tips may be of circumference between 14 mm and 44 mm, more preferably between 21 and 28 mm and of length between 15 and 40 mm. A tobacco smoke filter or filter element produced according to the invention may be of circumference 14 to 28 mm, for example 21 to 26 mm, for example 24 to 25 mm. For a 2.5 mm diameter strand, a filter of circumference 24 mm or above is preferred. A product tobacco smoke filter of the invention may be of length 10 to 40 mm, e.g. 15 to 35 mm, e.g. 20 to 30 mm. A product tobacco smoke filter element of the invention may be of length 5 to 30 mm, e.g. 6 to 20 mm, e.g. 8 to 15 mm, e.g. 10 to 12 mm.

Filters and filter elements produced according to the invention may be used in machine made cigarettes (e.g. those mass produced and packaged). Filters and filter elements according to the invention may also be used as (or in) a filter tip for use with a individually rolled cigarette (e.g a hand rolled cigarette) or a Roll Your Own or Make-your-own product.

A product filter element according to the invention may also be used as the mouth-end segment of a multi-segment filter, e.g. a dual, triple, other multiple filter. Such filters are well known in the art.

According to the present invention there is provided an apparatus for making tobacco smoke filter rods which include an (inner) strand of material extending longitudinally of the rod and a (longitudinally extending) outer layer of tobacco smoke filtering material engaged around the longitudinally extending strand; the apparatus comprising:

a delivery device for continuously advancing (e.g. delivering) the (inner) strand; and a gathering device (e.g. a garniture) for gathering a longitudinally advancing filtering material and condensing the gathering filtering material into rod form around the advancing (inner) strand to form the outer layer;

wherein the apparatus further comprises a heat treatment station for heat treating (e.g. to a temperature of 40° to 130° C., preferably to a temperature of 100° to 120° C.) the continuously advancing longitudinally extending inner strand; and a cooling station for cooling the heat treated continuously advancing (longitudinally extending) strand (e.g. to ambient temperature, e.g. to a temperature of 10° to 30° C., preferably to a temperature of 15° to 20° C.) prior to its advancement to the gathering device.

The apparatus may be used to make tobacco smoke filter rods which include one or more (inner) strands of material extending longitudinally of the rod and a (longitudinally extending) outer layer of tobacco smoke filtering material engaged around the longitudinally extending strand(s).

The or each (inner) strand of material extending longitudinally of the rod may be a preformed strand.

The or each (inner) strand may be a single (e.g. uncrimped) filamentary element.

The or each (inner) strand may be a material which is not a tobacco smoke filtering material (does not comprise tobacco smoke filter material). The strand may be impermeble or substantially impermeable to air and/or (tobacco) smoke. The apparatus may further comprise means for continuously advancing the (or each) strand of material under tension (e.g. straightened under tension) during the heat treatment (and optionally during the cooling step). The tension may be applied, for example, by (the action of)

advancing (e.g. pulling) the strand (e.g. from a holder, such as a reel or bobbin, on which it is stored), in which case the means may include the delivery device and e.g. the holder. The tension preferably straightens the strand (i.e. holds the strand straight) during the heat treatment (and optionally during the cooling step).

The apparatus may further comprise a positioning apparatus comprising a positioning channel through which the (or each) strand advances to the gathering device. The positioning apparatus may include a single delivery channel through which the strand or strands advance to the gathering device, or may include a positioning channel for each strand.

The positioning channel preferably guides the (or each) advancing strand in a direction which is substantially the same as the direction in which the (or each) strand advances after formation of the longitudinally extending outer layer around the (or each) strand. The positioning channel may also guide the (or each) advancing strand in a direction which is substantially the same as the direction in which the (or each) strand advances before travelling through the positioning channel (so the strand advances in substantially the same direction from the heating/cooling, through the positioning channel, until formation of the longitudinally extending outer layer around the strand). The positioning channel may comprise a hollow tube (e.g of internal diameter from 0.5 to 11 mm, preferably internal diameter from 0.5 to 2.7 mm, for example 0.7 to 2.6 mm, for example 1.2 to 2.5 mm) which is oriented in substantially the same as the direction in which the strand advances after formation of the longitudinally extending outer layer around the strand. The positioning channel guides the (or each) advancing strand into the correct position so the (or each) longitudinally extending outer layer is formed around the (or each) strand with the strand(s) located accurately within the outer layer. The (or each) strand (e.g. strand of circular or non-circular cross section) is preferably advanced longitudinally (e.g. passes, is fed) through the positioning channel (e.g. immediately) prior to formation of the longitudinally extending outer layer around the strand.

The positioning apparatus may further comprise an adjuster (e.g. adjuster mechanism) for adjusting the position of the positioning channel and the strand advancing there-through up and/or down, for example substantially vertically up and/or down, a substantially vertical axis with reference to the direction of advance of the longitudinally advancing filtering material. For example, the adjuster (e.g. adjuster mechanism, e.g. vertical adjuster) may be for adjusting the position of the positioning channel and the strand advancing there-through up and/or down a substantially vertical axis in a plane which is substantially perpendicular to the direction in which the filtering material is longitudinally advancing. Thus, the positioning apparatus may provide adjustment of the position of the strand within the product rod in the "x" axis, if the z axis is the longitudinal axis of the product rod (and the direction of advance/travel of the filtering material).

The positioning apparatus may include a lateral adjuster for adjusting the position of the positioning channel and the strand advancing there-through, across a substantially horizontal axis (direction—i.e. substantially left or right) with reference to the direction of advance of the longitudinally advancing filtering material. For example, the lateral adjuster (e.g. lateral adjuster mechanism) may be for adjusting the position of the positioning channel and the strand advancing there-through across (left and right) a substantially horizontal axis in a plane which is substantially perpendicular to the direction in which the filtering material is longitudinally advancing. Thus, the positioning apparatus may provide adjustment of the position of the strand within the product rod in the "y" axis, if the z axis is the longitudinal axis of the product rod (and the direction of advance/travel of the filtering material).

It will be appreciated that the adjusters may provide adjustment of the strand(s) positioning during product manufacture. Thus, the cut product rods may be assessed for positioning of the strand and, if this is not satisfactory, the position of the positioning apparatus and channel may be adjusted in the x or y direction with reference to the direction of advance of the tobacco smoke filtering material to thereby adjust the position of the strand within the product rod. Such methods of (e.g. "in line") testing of product rods are known and it will be appreciated that they may be combined with adjustment of positioning using the methods and apparatus of the invention.

Herein, the term filter rod includes individual filters and individual filter elements, which are well known in the art. The term also includes double or higher multiple (usually quadruple or sextuple) length filters or double or higher multiple (usually quadruple or sextuple) length filter elements, as are also well known.

The (product) filter rod may be of circumference 14 to 44 mm, more preferably 21 to 28 mm, for example 24 to 25 mm.

The apparatus may further comprise a wrapping device for wrapping the tobacco smoke filter rods (e.g. the rods formed by gathering the longitudinally advancing filtering material and condensing the gathering filtering material into rod form around the advancing continuous element). Wrapping devices are well known in the art.

The apparatus may further comprise a cutting device for cutting the tobacco smoke filter rods (e.g. the rods formed by gathering the longitudinally advancing filtering material and condensing the gathering filtering material into rod form around the advancing continuous element). The filter rods are made as a continuous rod. The continuous rod as it issues continuously from the production machine outlet is cut into finite lengths for subsequent use. This cutting may be into individual filters or filter elements, each of which is then attached to an individual wrapped tobacco rod to form a filter cigarette. More usually, however the continuously issuing rod is first cut into double or higher multiple (usually quadruple or sextuple) lengths for subsequent use. When the initial cut is into quadruple or higher lengths, then the latter are subsequently cut into double lengths for the filter cigarette assembly—in which the double length filter rod is assembled and joined (by ring tipping or full tipping overwrap) between a pair of wrapped tobacco rods with the combination then being severed centrally to give two individual filter cigarettes. It is this final severing which, in examples of cigarettes including filters or filter elements made using the apparatus of the invention, may reveal the end of the distinctively coloured and/or shaped element. The apparatus may make (e.g. double and higher) multiple length filter rods (and/or filter element rods), including a plurality of filter rods (filter element rods), e.g. joined end to end.

The invention includes any filter or filter element or filter rod produced according to the invention and/or by an apparatus according to the invention.

The invention includes any filter cigarette made using a filter produced according to the invention and/or by an apparatus according to the invention.

Figure 2:
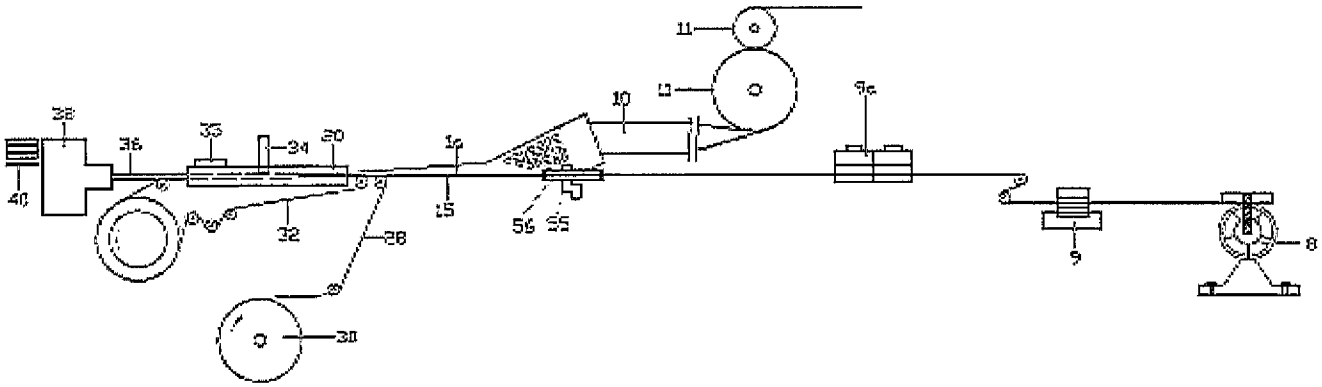

The present invention will now be illustrated with reference to the attached drawings in which:

FIG. 1 is an end view of a tobacco smoke filter produced according to an aspect of the invention; and FIG. 2 is a schematic side elevation view of an example of an apparatus for forming the filter of FIG. 1.

FIG. 1 shows one end of a filter (or element or rod), made by a process according to the invention. The filter comprises an outer layer 2*a* (substantially annular layer) of white-coloured plasticised cellulose acetate filamentary tow filtering material (formed from a multitude of plasticised cellulose acetate filaments which are bonded together to form a tobacco smoke filtering material). The outer layer (2*a*) is engaged around (and intimately surrounding) a strand (inner core) 1*a* having a heart shaped cross section which comprises a single extruded element formed from red-coloured (pigmented) plasticised cellulose acetate [i.e. a strand which is a single filamentary element (formed from plasticised cellulose acetate)]. The extruded cellulose acetate is impervious to smoke flow and therefore has no tobacco smoke filtering capability). The outer layer of white-coloured plasticised cellulose acetate filamentary tow 2*a* is encased in a plugwrap 3*a*. It will be appreciated that strand 1*a* is of heart shaped cross section. The contrast between the centrally located red heart-shaped strand and the white surrounding outer layer of filtering material provides an attractive and distinctive end appearance. Plugwrap paper 3*a* may be perforated (not shown) or air-permeable to provide a ventilated filter.

It will be appreciated that the filter of FIG. 1 may be joined at its upstream end to a wrapped tobacco rod (not shown) by means of, for example, a full tipping overwrap which surrounds and engages the full length of the filter and the adjacent end only of the wrapped tobacco rod, to form a filter cigarette. The filter of FIG. 1 may also be attached to a tobacco rod to form a filter cigarette by other means known in the art, such as ring tipping.

FIG. 2 shows a schematic side elevation view of an apparatus of the invention, for forming filters according to FIG. 1.

A band of cellulose acetate tow 10 is drawn through funnel 15, which has an internal wall converging downstream. In passing through the funnel 15 the tow 10 is gathered and largely condensed therein. The tow 10 is further gathered and condensed into rod form as it enters and passes through a gathering device in the form of a rod making and wrapping garniture 20.

A longitudinally extending strand of red-coloured (pigmented) plasticised cellulose acetate having heart shaped cross section (1*a*) is pre-formed by extruding plasticised cellulose acetate through a die, by methods well known in the art. It will be appreciated that various methods of making such shaped and pigmented strands are known in the art. The preformed longitudinally extending strand 1*a* is continuously advanced from a holder in the form of bobbin 8 through a heat treatment station 9 where it is exposed to steam at a temperature of 120° C. The strand 1*a* has a cross section of width (at its broadest point) 2.4 mm.

The heat treated strand 1*a* is then advanced through a cooling station 9*a* where it is cooled using air to approximately 18° C. It will be appreciated that the action of advancing (i.e. pulling) the strand from bobbin 8 has the effect that the continuously advancing (longitudinally extending) strand of material 1*a* is under tension (and straightened) during the heat treatment and cooling. Preprocessing the strand by heating it (in heat treatment station 9) and cooling it (in cooling station 9*a*), preferably under tension, prior to forming the outer layer greatly reduces or eliminates the bowing or bending effect caused by storage of the pre-formed strand on bobbin 8.

The heat-treated and cooled strand 1*a* is then continuously advanced by additional rollers (not shown) which are motorized (coupled and synchronized to the main machine motor) in order to pull the strand towards a positioning apparatus 55 which includes a positioning channel in the form of a hollow tube 56 of internal diameter 2.5 mm. The additional rollers (not shown) pull the strand 1*a* so it enters apparatus 55 and funnel 15, and are required because the moving tow is unable to pull the strand simply through frictional forces. Prior to entrance of the strand to apparatus 55, it may be passed through a unit to spray flavour solution onto the strand or may be passed through a sensor to detect strand breakage (so that the machine automatically stops). These additional units are not shown.

The strand 1*a* continuously advances from (i.e. exits) tube 56 and is drawn directly into engagement with the longitudinally advancing gathering (and largely condensed) tow 10 in funnel 15. The strand 1*a* travels with the tow to and through the rod making and wrapping garniture 20, where the tow 10 is further gathered and condensed into rod form around strand 1*a* such that the strand 1*a* is incorporated in a product continuous rod including a longitudinally extending strand of material 1*a* (extending longitudinally of the rod) and a longitudinally extending outer layer of filtering material (formed by tow 10) engaged around the longitudinally extending strand. It will be appreciated that tow 10 forms outer layer 2*a* in FIG. 1. The positioning apparatus 55 guides the advancing strand 1*a* in a direction which is substantially the same as the direction in which the strand 1*a* advances after formation of the longitudinally extending outer layer around the strand, thereby guiding the advancing strand 1*a* into the correct position so the longitudinally extending outer layer 2*a* of tow 10 is formed around the strand with the strand located centrally within the outer layer.

On start up of the apparatus, the tow is threaded through the machine and funnel 15 into the garniture 20, and the free end of strand 1*a* is threaded through stations 9, 9*a* and tube 56 of positioning apparatus 55, and stuck to the tow upstream of funnel 15. Thus, once the apparatus is started, the advancing tow continuously entrains the strand 1*a* which is being drawn (advances it) under tension continuously from the bobbin 8 through stations 9, 9*a* and positioning device 55 to tow 10.

Wrapping paper 28 is drawn continuously from reel 30 and fed continuously into the garniture 20, the paper 28 and the tow incorporating the strand 1*a* being carried continuously through the garniture by a delivery device in the form of endless conveyor belt 32. In the garniture 20, the tow is shaped to rod form, and the paper 28 is wrapped around and secured with a lapped and stuck seam; member 34 applies a line of adhesive to one edge of paper 28, before the overlapping edges are bought into engagement. The continuously produced wrapped rod 36 passes to a cutter 38 which severs the rod 36 into individual lengths 40 each of which include a continuous element 22. The lengths 40 may be single filter or filter elements (such as those of FIG. 1), but, more usually, will be multiple double or higher multiple (usually quadruple or sextuple) lengths for subsequent use, as is well known.

The invention claimed is:

1. A method of producing a tobacco smoke filter or filter element comprising:

heat treating a continuously advancing longitudinally extending preformed strand of material;

cooling the heat treated continuously advancing longitudinally extending preformed strand of material; and forming a longitudinally extending outer layer of tobacco smoke filtering material around the continuously advancing longitudinally extending preformed strand of material subsequent to said cooling, to form a continuously advancing rod comprising the longitudinally extending preformed strand of material and the longitudinally extending outer layer of tobacco smoke filtering material engaged around the longitudinally extending preformed strand of material;

wherein the preformed strand is formed at least 15 minutes before the longitudinally extending outer layer of tobacco smoke filtering material is formed around the continuously advancing longitudinally extending preformed strand of material; and in which the continuously advancing longitudinally extending preformed strand of material is under tension during the heat treatment.

2. A method according to claim 1 in which the longitudinally extending preformed strand of material does not comprise a tobacco smoke filtering material.

3. A method according to claim 1 in which the preformed strand of material is a single filamentary element.

4. A method according to claim 1 in which the continuously advancing longitudinally extending preformed strand of material has a non-circular cross section.

5. A method according to claim 1 in which the preformed strand of material is advanced longitudinally through a positioning apparatus prior to formation of the longitudinally extending outer layer of tobacco smoke filtering material around the preformed strand of material.

6. A method according to claim 5 in which the positioning apparatus guides the advancing preformed strand of material in a direction which is substantially the same as a direction in which the preformed strand of material advances after formation of the longitudinally extending outer layer of tobacco smoke filtering material around the preformed strand of material.

7. A method according to claim 1 in which the preformed strand of material is an extruded material.

8. A method according to claim 1 in which the preformed strand of material comprises extruded cellulose acetate.

9. A method according to claim 1 in which the preformed strand of material and/or the outer layer of tobacco smoke filtering material includes a pigment.

10. A method according to claim 1 in which the preformed strand of material is of a contrasting colour to the outer layer of tobacco smoke filtering material.

11. A method according to claim 1 further comprising a step of applying a wrapper around the continuously advancing rod.

12. A method according to claim 1 further comprising a step of cutting the continuously advancing rod into single or multiple length filters or filter elements.

13. A method of producing a tobacco smoke filter or filter element comprising:

heat treating two or more continuously advancing longitudinally extending preformed strands of material;

cooling the heat treated continuously advancing longitudinally extending strands of material; and forming a longitudinally extending outer layer of tobacco smoke filtering material around the continuously advancing longitudinally extending strands of material subsequent to said cooling, to form a continuously advancing rod comprising the longitudinally extending preformed strands of material and the longitudinally extending outer layer of tobacco smoke filtering material engaged around the longitudinally extending preformed strands of material;

wherein the preformed strands are formed at least 15 minutes before the longitudinally extending outer layer of tobacco smoke filtering material is formed around the continuously advancing longitudinally extending preformed strands of material; and in which each continuously advancing longitudinally extending preformed strand of material is under tension during the heat treatment.

14. A method according to claim 13 in which the longitudinally extending preformed strands of material do not comprise a tobacco smoke filtering material.

15. A method according to claim 13 in which each of the preformed strands of material is a single filamentary element.

* * * * *